United States Patent [19]

Handa

[11] 4,084,634

[45] Apr. 18, 1978

[54] SEAL ASSEMBLY FOR ROTARY DISC-TYPE MATRIX OF GAS TURBINE ENGINE

[75] Inventor: Noritoshi Handa, Yokosuka, Japan

[73] Assignee: Nissan Motor Company, Limited, Japan

[21] Appl. No.: 723,638

[22] Filed: Sep. 15, 1976

[30] Foreign Application Priority Data

Sep. 22, 1975 Japan ..... 50-113708

[51] Int. Cl.[2] ..... F28D 19/00

[52] U.S. Cl. ..... 165/9; 277/81 S; 277/93 R; 277/192

[58] Field of Search ..... 165/9; 277/81 R, 81 S, 277/93 R, 192

[56] References Cited

U.S. PATENT DOCUMENTS 1,837,115 12/1931 Cook ..... 277/192 X 3,667,220 6/1972 Debeyser ..... 165/9 X 3,882,927 5/1975 Penny ..... 165/9

FOREIGN PATENT DOCUMENTS 2,351,710 5/1974 Germany ..... 165/9

*Primary Examiner*—Albert W. Davis, Jr.

*Attorney, Agent, or Firm*—Lane, Aitken, Dunner & Ziems

[57] ABSTRACT

Friction shoes are placed end-to-end to define a closed shape around a sector on a disc-type matrix and located in a groove cut into a support having two groove walls that cooperate to define the groove therebetween. Each of the friction shoes is biased toward one of the groove walls by a springy plate to effect a seal contact with the one groove wall. A bellows is located on a housing enclosing the matrix and the support.

10 Claims, 5 Drawing Figures

SEAL ASSEMBLY FOR ROTARY DISC-TYPE MATRIX OF GAS TURBINE ENGINE

The present invention relates to a gas turbine engine having a rotary disc-type matrix rotating in a housing with sectors of the matrix being subjected to gas streams of differing pressures or a regenerative heat-exchanger of the kind employing a rotary disc-type matrix.

The regenerative heat-exchanger of the kind referred to is usually incorporated in gas turbine engines for automobiles to extract heat from the exhaust gases, and to transfer it to the compressed intake-air before this enters the combustion chamber of the gas turbine engine. The rotary disc-type matrix, which is rotatable in a housing of the engine, comprises a foraminous refractory core (e.g. of ceramic material) formed with a multitude of open ended, thin walled passages lying substantially parallel to its rotational axis. Sector-like zones of the core are caused (by its rotation) to be presented alternatively to the flow of the exhaust gases and to the flow of the compressed intake-air. In that way the required heat transfer is effected.

It is of course necessary to separate the two gaseous flows at all times, and to minimize leakage between the high-pressure low-temperature zone, occupied by the compressed intake-air, and the low-pressure high temperature zone occupied by the exhaust gases. To this end, it is common practice to employ a sealing element or friction seal that makes rubbing contact with the corresponding face of the matrix, and which is located and supported by a support that is mounted on a bellows fixed to the housing of the engine. This support is formed with a groove and the sealing element is fixed to the groove bottom wall by means of a coating cement, the coating cement being disposed between the sealing element and the groove bottom wall. This sealing assembly has a problem that the layer of the coating cement is apt to break because it is itself subject to thermal distortion relative to the matrix, and consequently produce leakage between the matrix face and the sealing counter surface or between the opposite surface of the sealing element and the groove bottom wall of the support. This causes a deterioration in sealing efficiency and consequently a deterioration in efficient operation of the engine. Another problem is that replacement of a sealing element is difficult because the sealing element is fixed with respect to the support by means of coating cement although the sealing element is apt to wear at a relatively high rate and requires frequent replacement during the life of the engine.

The present invention aims at alleviating the problems and it is an object of the present invention to provide a sealing assembly which has eliminated the use of coating cement.

According to the present invention a gas turbine engine having a rotary disc-type matrix in a housing with sectors of the matrix being subjected to gas streams of differing pressures, is equipped with a sealing assembly which comprises: friction shoes placed end-to-end to define a closed shape around one of the sectors, the friction shoes being positioned between the housing and the matrix and sliding against the matrix; a support positioned between the housing and the friction shoes, the support having a groove in which the friction shoes are located and first and second spaced groove walls that cooperate to define the groove therebetween; each of the friction shoes having a first side surface contacting with the first groove wall and the opposite or second side surface facing the second groove wall having a pair of longitudinal slots therein; springy plates corresponding in number to the friction shoes, each having its longitudinal end portions inserted into the pair of longitudinal slots of the corresponding one of said friction shoes so that its intermediate portion bows away from the opposite side surface of the corresponding one of the friction shoes, the intermediate portion contacting with or bearing against the second groove wall to urge the corresponding one of the friction shoes toward the first groove wall; and a bellows located on the housing between the housing and support.

The present invention will become clear from the following description in connection with the accompanying drawings, in which.

Figure 1:
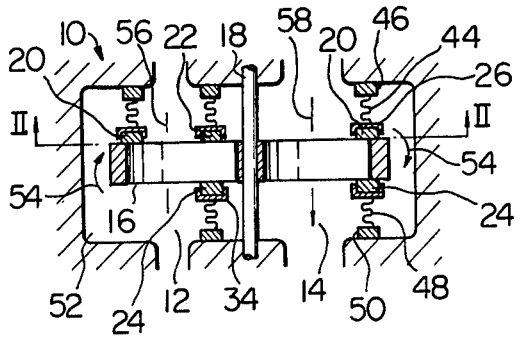
FIG. 1 is a partial sectional view through a gas turbine engine showing a rotary disc-type matrix installation utilizing the sealing assembly according to the present invention.

Referring to FIG. 1, the housing generally indicated by the numeral 10 of a gas turbine engine forms semicircular passages 12 and 14. A disc-type matrix 16 is mounted rotatably on a spindle 18 and is driven by appropriate means such as gearing (not shown) attached to its periphery.

Figure 2:
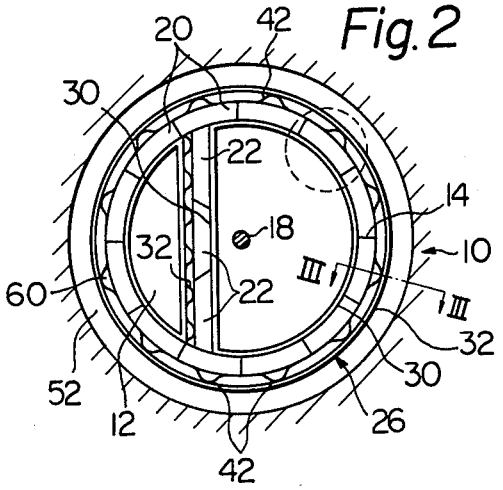
FIG. 2 is a plan view of the sealing assembly taken along line II—II of FIG. 1.

Positioned between the disc-type matrix 6 and the housing 10 are segments or friction shoes 20 and 22 placed one after another. As best seen in FIG. 2, the friction shoes 20 are placed end-to-end to surround the semicircular periphery of the passage 12 and that of the passage 14, while the friction shoes 22 are placed end-to-end to form a straight crossarm shoe that fits between side surfaces of the friction shoes 20. Positioned between the other side of disc-type matrix 6 and the housing 10 are friction shoes 24 (see FIG. 1) placed one after another to define a D-shaped shoe around the passage 14.

A support 26 positioned between the housing 10 and the friction shoes 20 and 22 locates and supports the friction shoes 20 and 22. The support 26 has a groove 28 receiving the friction shoes 20 and 22 and first and second spaced groove walls 30 and 32 (see FIG. 3) that cooperate to define the groove therebetween. A similar support 34 between the housing and the friction shoes 24 locates and supports the friction shoes 24.

Figure 3:
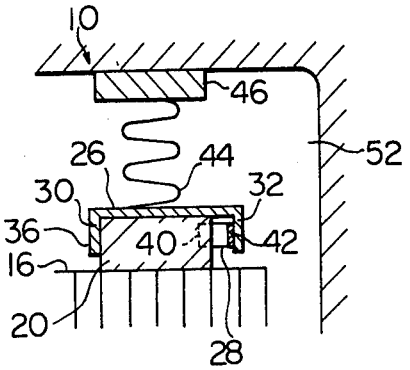
FIG. 3 is an enlarged cross-sectional view of the sealing assembly taken along line III—III of FIG. 2.
Figure 4:
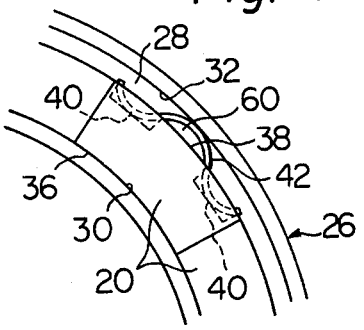
FIG. 4 is an enlarged plan view of a portion enclosed by a circle indicated by dotted lines in FIG. 2.

As best seen in FIGS. 3 and 4, each of the friction shoes such as 22 has a first side surface 36 contacting with the groove wall 30 and the opposite or second side surface 38 facing the groove wall 32. The second side surface is formed with a pair of longitudinal slots 40.

Springy plates 42 correspond in number to the friction shoes 20, 22 and 24, each having its longitudinal end portions which are curled inserted into the pair of slots 40 (see FIG. 4) of the corresponding one friction shoe such as 20 so that its intermediate portion bows resiliently away from the second side surface 38 of the friction shoe. The intermediate portion of each of the springy plates 42 contacts with or bears against the groove wall 32 to urge the corresponding friction shoe 20 (see FIG. 4) towards the groove wall 30.

The friction shoes 20, 22 and 24 are sized so that their first side surfaces 36 contact complementarily with the groove walls 30 and at their ends they are cut to be placed one after another to avoid leakage. For example at each of the longitudinal ends of each of the friction shoes 20 is cut substantially in line with a direction of the urging force by the corresponding springy plate 42 and the friction shoes 20 are engaged end-to-end to avoid leakage.

A bellows 44 is located on the housing 10 between the housing and the support 26. The sealing around the passages 12 and 14 is ensured by the bellows 44, the bellows 44 being secured between a plate 46 secured to the housing 10 and the support 26. The sealing around the passage 14 on the outlet side of the disc-type matrix 16 is ensured by a bellow 48 secured between a plate 50 secured to the housing 10 and the support 34 (see FIG. 1). The bellows 44 and 48 are preferably made of a spring tempered metal. With the bellows the supports 26 and 34 hold the friction shoes 20 and 22 and friction shoes 24 against the both sides of the disc-type matrix 16, respectively.

During engine operation, relatively cool air from the engine compressor passes into chamber 52 and the compressed air contacts the entire periphery of the matrix 16 in the direction of arrows 54. Air from the chamber 52 passes through the left sector of the matrix 16, as viewed in FIG. 1 in the direction of arrow 56 through the passage 12. The passage 12 conducts the air to the engine combustion chamber and thence to the turbine wheels (not shown).

Relatively hot combustion gases from the engine turbine wheels pass through the passage 14 in the direction of arrow 58 and through the right sector of the disc-type matrix, as viewed in FIG. 1. The rotating matrix 16 transfers heat from the exhaust gases leaving the passage 14 to the gases entering the passage 12 in the conventional manner.

Compressed air in the chamber 52 can be applied to the space 60 between each of the springly plates 42 and the side surface 38 of the corresponding one friction shoe 20 (see FIG. 4) to urge the shoe 20 toward the groove wall 30. Such air assists in maintaining sealing contact between the friction shoes and the groove wall. Cooling of the springy plates 42 and the bellows 44 and 48 can be achieved by the air from the chamber 52 which is relatively cool.

The springy plates 42 are held out of contact with the face of the matrix 16 by inserting their end portions in the corresponding slots 40 formed in the friction shoes 20, 22 and 24. Thus there is no fear that the springy plates 42 might damage the face of the matrix 16.

Figure 5:
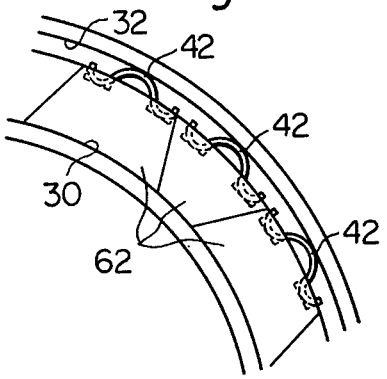
FIG. 5 is a plan view of a second embodiment of a sealing assembly according to the present invention.

The segments or friction shoes 62 (see FIG. 5) are formed on a similar principle but with a structure that each of the longitudinal ends of each of the friction shoes 62 is cut at an angle to direction of the urging force by the corresponding springy plate 42 and each friction shoe 62 is in the form of a wedge. This structure permits the friction shoes 62 to be engaged end-to-end firmly due to the wedge effect and to close slight clearance between the ends of the friction shoes 62, thus absorbing manufacturing tolerance.

What is claimed is:

1. In a gas turbine engine having a rotary disc-type matrix rotating in a housing with sectors of said matrix being subjected to gas streams of differing pressure, a sealing assembly comprising:

friction shoes placed one after another, said friction shoes being positioned between said housing and said matrix and sliding against said matrix;

a support positioned between said housing and said friction shoes, said support having a groove receiving said friction shoes and first and second spaced groove walls that cooperate to define the groove therebetween;

each of said friction shoes having a first side surface contacting with said first groove wall and a second side surface opposite to the first side surface facing said second groove wall, said second wall having a pair of slots therein;

springy plates corresponding in number to said friction shoes, each having its longitudinal end portions inserted into the pair of slots of the corresponding one of said friction shoes so that its intermediate portion bows resiliently away from the second surface of the corresponding one of said friction shoes, said intermediate portion contacting with said second groove wall to urge the corresponding one of said friction shoes toward said first groove wall; and a bellows located on said housing between said housing and support.

2. A gas turbine engine as claimed in claim 1, further comprising means for transmitting the gas pressure of one of said sectors into the space defined by each of said springy plates and the second side surface of the corresponding one of said friction shoes, said gas pressure assisting in urging the corresponding one of said friction shoes toward said first groove wall.

3. A gas turbine engine as claimed in claim 1, in which each of longitudinal ends of each of said friction shoes is cut substantially in line with direction of urging force by the corresponding one of said springy plates.

4. A gas turbine engine as claimed in claim 1, in which each of longitudinal ends of each of said friction shoes is cut at an angle to direction of urging force by the corresponding one of said springy plates.

5. In a gas turbine engine having a rotary disc-type matrix rotating in a housing with sectors of said matrix being subjected to gas streams of differing pressure, a sealing assembly comprising:

friction shoes placed one after another, said friction shoes being positioned between said housing and said matrix and sliding against said matrix;

a support positioned between said housing and said friction shoes, said support having a groove receiving said friction shoes and first and second spaced groove walls that cooperate to define the groove therebetween;

each of said friction shoes having a first side surface contacting with said first groove wall and a second side surface opposite to the first side surface facing said second groove wall, each of said friction shoes having a pair of slots formed at its second side surface;

springy plates corresponding in number to said friction shoes, each having its longitudinal end portions inserted into the pair of slots of the corresponding one of said friction shoes so that its intermediate portion bows resiliently away from the second side surface of the corresponding one of said friction shoes, said intermediate portion contacting with said second groove wall to urge the corresponding one of said friction shoes toward said first groove wall;

the longitudinal ends of each of said friction shoes being cut an angle to the direction of urging force by the corresponding one of said springy plates so that each of said friction shoes is in the form of a wedge; and a bellows located on said housing between said housing and said support to urge said friction shoes into contact with said matrix.

6. A regenerative heat-exchanger comprising:

a housing;

a rotary disc-type matrix rotatable within a housing with sectors of said matrix being subjected to gas streams of differing pressures;

a support having a groove, said groove having a bottom wall, a first side wall and a second side wall, said bottom wall, said first side wall and said second wall cooperating to define said groove;

a plurality of friction shoes received in said groove and placed one after another;

each of said friction shoes having two longitudinal ends, each contacting with one of the longitudinal ends of adjacent one of said friction shoes;

each of said plurality of friction shoes having a side adapted for sliding against said matrix and an opposite side contacting with said bottom wall of said support;

each of said plurality of friction shoes having a first side surface contacting said first side wall of said groove and a second side surface opposite to said first side surface and spaced from said second side wall of said groove;

bellow means located on said housing and said support to urge said support toward said matrix to maintain sliding contact of said plurality of friction shoes against said matrix; and a plurality, corresponding in number to said plurality of friction shoes, of spring means, each disposed between said second side wall of said groove and the second side surface of the corresponding one of said plurality of friction shoes, for biasing said plurality of friction shoes toward said first side wall of said groove, respectively, to urge said plurality of friction shoes into contact with said first side wall of said groove.

7. A regenerative heat-exchanger as claimed in claim 6, wherein each of said plurality of spring means is in the form of a springy elongated plate and each of said plurality of friction shoes have formed in its second side surface a pair of slots spaced from each other, the longitudinal end portions of said springy plates being inserted into the pair of slots of the corresponding one of said plurality of friction shoes so that their intermediate portion bows resiliently away from the second side surface of the corresponding one of said plurality of friction shoes and contacts said second side wall of said groove.

8. A regenerative heat-exchanger as claimed in claim 6, wherein each of the longitudinal ends of each of said plurality of friction shoes is cut substantially in line with the direction of biasing force by the corresponding one of said plurality of spring means.

9. A regenerative heat-exchanger as claimed in claim 6, wherein each of the longitudinal ends of each of said plurality of friction shoes is cut at an angle to the direction of biasing force by the corresponding one of said plurality of spring means.

10. A regenerative heat-exchanger as claimed in claim 9, wherein each of said plurality of friction shoes is in the form of a wedge.

* * * * *